US006996451B1

(12) United States Patent
Asai et al.

(10) Patent No.: US 6,996,451 B1
(45) Date of Patent: Feb. 7, 2006

(54) CONTROL DEVICE FOR SEWING MACHINES

(75) Inventors: Norihiko Asai, Kasugai (JP); Yuji Ilda, Chita (JP); Ayako Yoshimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/187,896

(22) Filed: Jul. 25, 2005

(30) Foreign Application Priority Data

Jul. 28, 2004 (JP) ..... 2004-219920

(51) Int. Cl.
*G06F 19/00* (2006.01)
*D05B 69/36* (2006.01)

(52) U.S. Cl. ..... 700/136; 112/470.01; 112/278

(58) Field of Classification Search ..... 700/136, 700/137; 112/470.01, 470.04, 273, 278
See application file for complete search history.

(56) References Cited

U.S. PATENT DOCUMENTS 5,184,560 A * 2/1993 Asano ..... 112/470.02
6,123,037 A * 9/2000 Shimizu ..... 112/102.5

FOREIGN PATENT DOCUMENTS

JP 04-166189 A 6/1992

* cited by examiner

*Primary Examiner*—Peter Nerbun
(74) *Attorney, Agent, or Firm*—Oliff & Berridge, PLC

(57) ABSTRACT

The present disclosure relates to a control device to control a sewing machine which executes a sewing operation using a bobbin thread wound on a bobbin and a needle thread by the drive of the sewing machine motor. The control device includes a sewing restarting unit that restarts the sewing operation after stopping the sewing machine motor in response to a detection of bobbin thread scarcity by a bobbin thread remaining amount detection unit. A permitted sewing amount is preset for the sewing operation restarted after stopping the sewing machine motor and when an actual amount of sewing performed after the stop of the sewing machine motor reaches the permitted sewing amount, information is given by the control device.

13 Claims, 7 Drawing Sheets

CONTROL DEVICE FOR SEWING MACHINES

CROSS-REFERENCE TO RELATED APPLICATIONS

This application is based upon and claims the benefit of priority from the prior Japanese Patent Application No. 2004-219920, filed on Jul. 28, 2004 the entire contents of which are incorporated herein by reference.

BACKGROUND

This disclosure relates to a control device of a sewing machine to execute a sewing operation using a needle thread and a bobbin thread.

Some conventional types of embroidery sewing machines or lockstitch sewing machines are provided with a detection device to detect a remaining amount of bobbin thread wound on a bobbin. In such sewing machines, when a scarcity of remaining amount of bobbin thread wound on the bobbin is detected during an embroidery process, a warning message is displayed as well as forcibly stopping the sewing process. Thus, an execution of a sewing process without the bobbin thread can be prevented.

For example, in Japanese Patent No. 3194432, a sewing machine provided with a bobbin thread remaining amount detection device composed of a reflection type bobbin thread remaining amount sensor is disclosed. This reflection type bobbin thread remaining amount sensor is placed beside a rotary hook positioned below the needle plate having a light emitting element and a light receiving element. The bobbin thread remaining amount detection device detects a bobbin thread remaining amount based on a detection signal outputted from the light receiving element which receives a spot light emitted by the light emitting element when in a needle raised position during a sewing process. When it is detected that a bobbin thread remaining amount has become equal to or less than a predetermined amount by the bobbin thread remaining amount detection device, the sewing machine stops the drive of a sewing machine motor or sets off a warning sound.

Sewing machines have been provided having a bobbin thread remaining amount detection device besides the above, configured by a permeable bobbin thread remaining amount sensor having a light emitting element and a light receiving element arranged to face the rotary hook.

The bobbin is wound with bobbin threads varying in thickness, material and color. Therefore, even in cases when the scarcity of the bobbin thread remaining amount is detected by the bobbin thread remaining amount detection device configured by the reflection type or the permeable type light sensor, it is possible for the bobbin to have approximately 30 cm to 80 cm of bobbin thread remaining, wherein the bobbin thread is wound possibly up to few dozen times. Thus, the bobbin thread remaining amount detection device is not capable of accurately detecting the bobbin thread remaining amount for every thread type.

Furthermore, the conventional sewing machines are configured to immediately stop the drive of the sewing machine motor or set off a warning sound when a remaining amount of the bobbin thread wound on the bobbin has become less than the prescribed amount. Therefore, the remaining approximately 30 cm to 80 cm of bobbin thread is not used and wasted. Also, when a large amount of bobbin thread remains unused, the bobbin needs to be supplied with bobbin thread more frequently, thereby reducing the efficiency of the work.

SUMMARY

The purpose of this disclosure is to provide a sewing machine that is capable of using up a bobbin thread to a possible extent.

A control device of a sewing machine of the disclosure controls a sewing machine which executes a sewing operation using a needle thread and a bobbin thread by the drive of the sewing machine motor.

The control device of a sewing machine includes a bobbin thread remaining amount detection unit that detects a bobbin thread remaining amount, a stopping unit that stops the sewing machine motor when a scarcity of a remaining amount of the bobbin thread is detected by the bobbin thread remaining amount detection unit and a sewing restarting unit that restarts the sewing operation after stopping the sewing machine motor by the stopping unit. The control device further includes a permitted sewing amount setting unit that sets a permitted sewing amount after stopping the sewing machine motor by the stopping unit, an actual sewing amount calculation unit that calculates an actual sewing amount after stopping the sewing machine motor, and a informing unit that informs, when the actual sewing amount calculated by the actual sewing amount calculation unit reaches the permitted sewing amount.

According to the above configuration, when the scarcity of the bobbin thread is detected, the sewing machine motor is stopped and driven again to restart the sewing operation. The restarted sewing operation is continued until the predetermined permitted sewing amount is reached after outputting the warning. Therefore, the bobbin thread remaining on the bobbin can be used efficiently.

In this case, when the scarcity of the bobbin thread remaining amount is detected, instead of stopping the sewing machine motor with the stopping unit, it is recommended to provide a warning unit and make the permitted setting amount setting unit set the permitted sewing amount of the sewing operation after outputting the warning.

According to the above configuration, when the scarcity of the bobbin thread is detected, the sewing operation is performed until the permitted sewing amount is reached after outputting the warning. Therefore, even in the above configuration, the bobbin thread remaining in the bobbin can be efficiently used.

BRIEF DESCRIPTION OF THE DRAWINGS

Other objects, features and advantages of the disclosure will become clear upon reviewing the following description of the embodiment with reference to the accompanying drawings, in which.

DETAILED DESCRIPTION OF THE INVENTION

Figure 1:
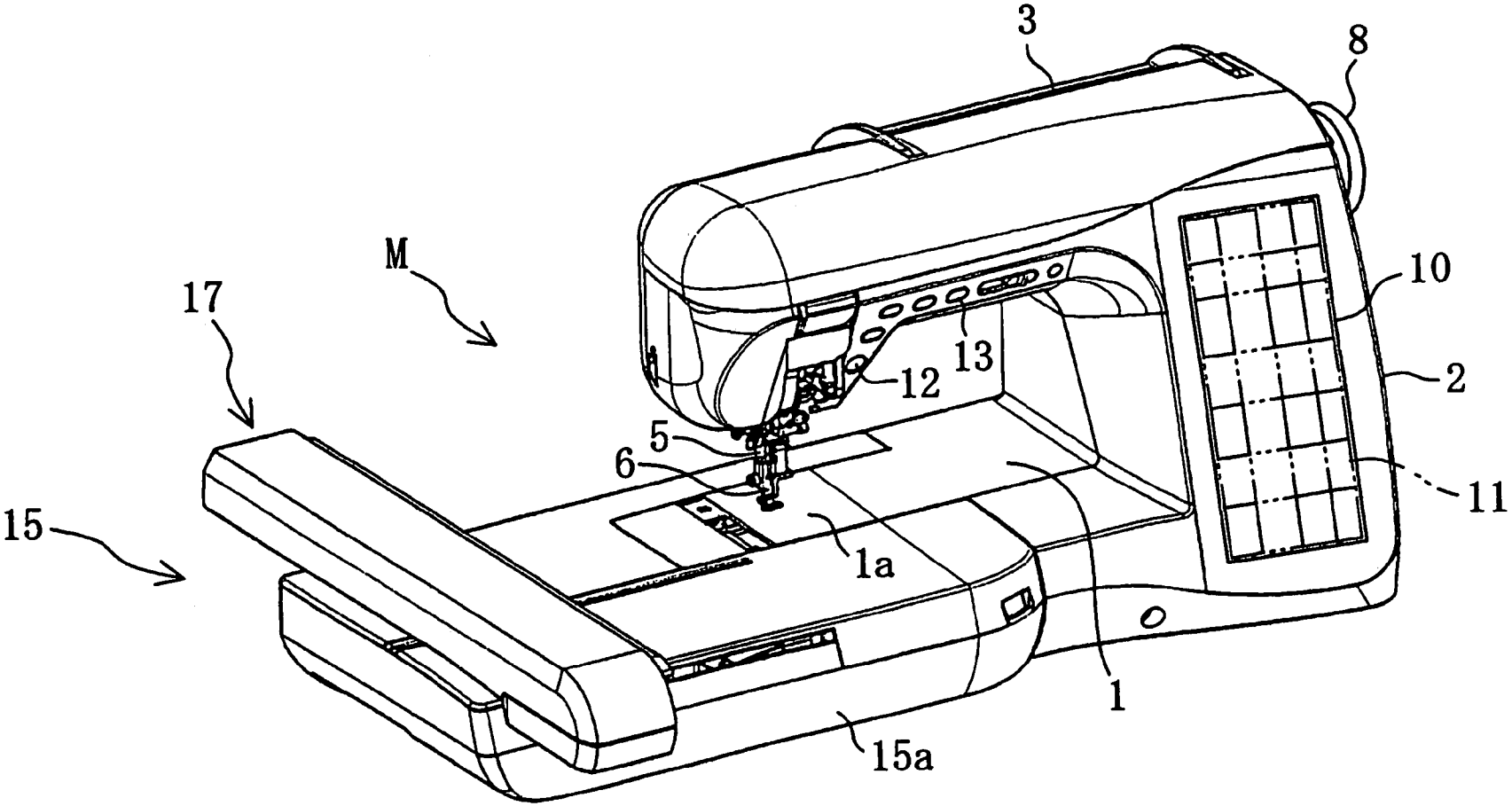
FIG. 1 is a perspective view of an embroidery sewing machine in accordance with the first embodiment of the disclosure.

A first embodiment of the disclosure applied to a domestic embroidery sewing machine is described with reference to FIGS. 1 to 7. As shown in FIG. 1, an embroidery sewing machine M according to the disclosure is a domestic electronically controlled sewing machine known in the art and is provided with a bed 1 having a needle plate 1*a*, a pillar 2 standing upright on the right end of the bed 1 and an arm 3 extending to the left from the pillar 2 over the sewing machine bed 1.

Inside the bed 1, more particularly, below the needle plate 1*a*, a feed dog vertically moving mechanism (not shown) to vertically move the feed dog, a feed dog longitudinally moving mechanism (not shown) to longitudinally move the feed dog, a rotary hook 7 (refer FIG. 2) accommodating a bobbin 25 working co-operatively with the sewing needle 6, a thread trimming mechanism (not shown) and a bobbin thread remaining amount detector 30 (refer FIG. 2) are provided.

On the front side of the pillar 2, a large type color liquid crystal display 10 is provided (hereinafter referred to as color display). In the color display 10, various types of sewing patterns such as actual patterns and embroidery patterns, names of the functions required for the embroidery work and various types of messages are displayed.

On the front side of the color display 10, an operation panel in a matrix form is provided. Touch keys 11 composed of transparent electrodes are provided on the display and the touch keys 11 are mated with the location of the items appearing on the display such as: names of pluralities of actual patterns, embroidery patterns and various functions; and numerical settings for feed amount and needle swing amount etc. in various setting screens. The user can select the embroidery patterns to be sewn, instruct the execution of functions, and perform numerical settings etc. by pressing the touch keys 11.

In the arm 3, a laterally extending sewing machine main shaft (not shown), a hand pulley 8 to rotate the sewing machine main shaft, a needle bar vertically moving mechanism (not shown) to vertically move the needle bar 5 attached with a sewing needle 6 in a lower end, a needle bar swinging mechanism (not shown) to swing the needle bar 5 to a direction perpendicular to the fabric feeding direction (longitudinal direction) and a thread take-up drive mechanism(not shown) to vertically move the thread take-up (not shown) vertically moving in synchronization with the vertical movement of the needle bar 5 are provided.

Figure 4:
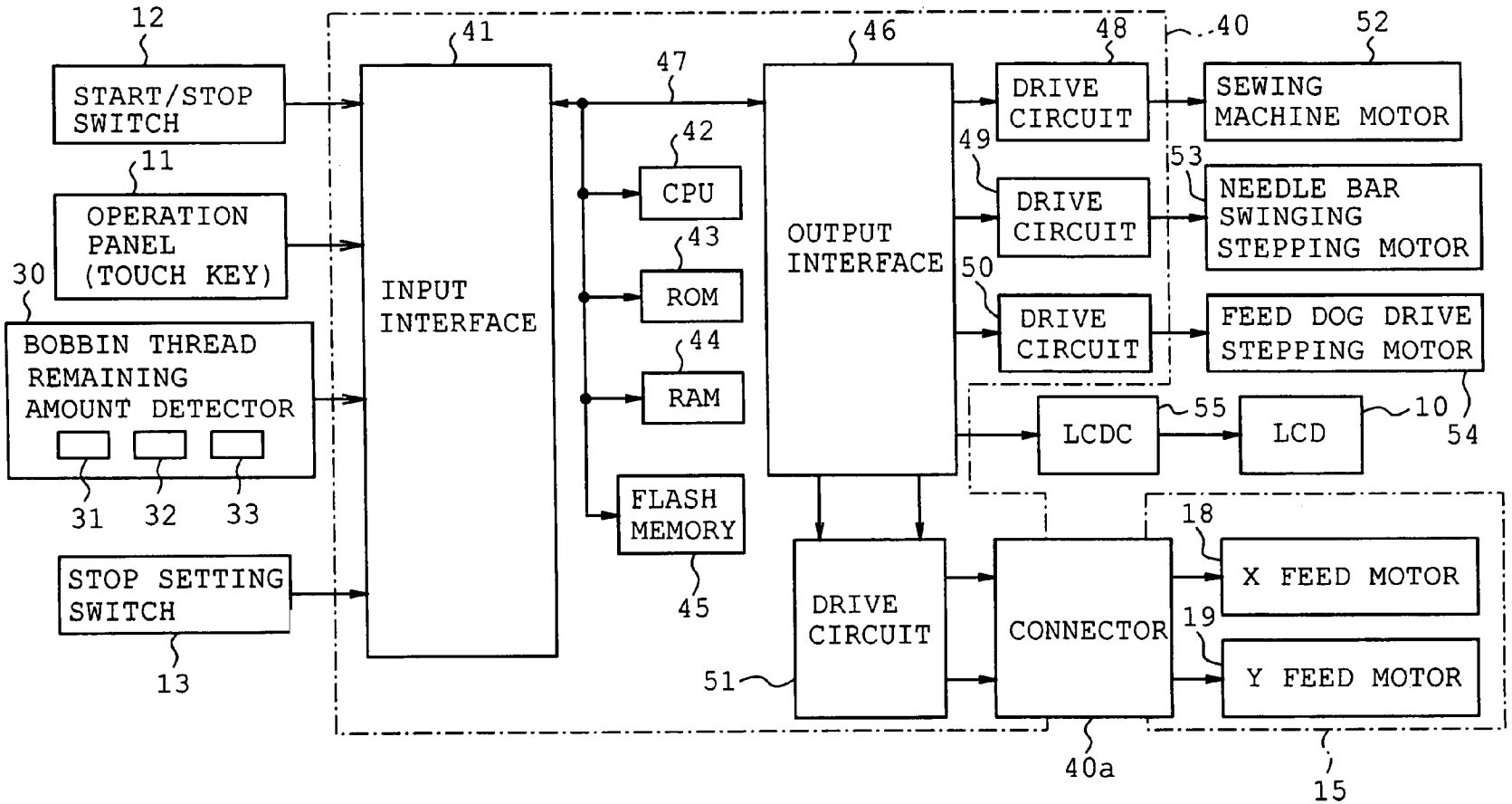
FIG. 4 is block diagram of a control system of an embroidery sewing machine.

The sewing machine main shaft is rotatably driven by the sewing machine motor 52 (refer to FIG. 4). The feed dog vertically moving mechanism and the needle bar vertically moving mechanism are driven via the sewing machine main shaft. On the other hand, the needle bar swinging mechanism is driven independently by a needle bar swinging stepping motor 53 (refer to FIG. 4) and the feed dog longitudinally moving mechanism is independently driven by a feed dog longitudinally driving stepping motor 54 (refer to FIG. 4).

On the front of the arm 3, a start/stop switch 12 and stop setting switch 13 etc. are provided. The start/stop switch 12 instructs the start and stop of the embroidery work. The stop setting switch 13 is for setting whether or not to stop the drive of the sewing machine motor 52 when the scarcity of a bobbin thread 24 wound on a bobbin 25 is detected by a bobbin thread remaining amount detector 30.

On the left end of the bed 1, an embroidery frame drive mechanism 15 is detachably attached. The embroidery frame drive mechanism 15 drives the embroidery frame (not shown) in the x direction (lateral direction) and y direction (longitudinal direction) independently.

The embroidery frame drive mechanism 15 is configured by a y direction driver 17 incorporating a y direction drive mechanism, an x direction drive mechanism to drive the y-direction driver 17 to the x direction (lateral direction), an X feed motor 18 to drive the x direction drive mechanism (refer to FIG. 4) and Y feed motor 19 (refer to FIG. 4) to drive the y direction drive mechanism.

When the embroidery frame drive mechanism 15 is attached to the left end of the bed 1, the embroidery sewing mode is set. At this point, the X feed motor 1B and the Y feed motor 19 are electronically connected to the output interface 46 of the control device 40 of the embroidery sewing machine M via a connector 40*a* (refer to FIG. 4). Hence, the X feed motor 18 and Y feed motor 19 are driven independently of each other. When the embroidery frame drive mechanism 15 is detached, a utility sewing mode is set to replace the embroidery sewing mode.

Figure 2:
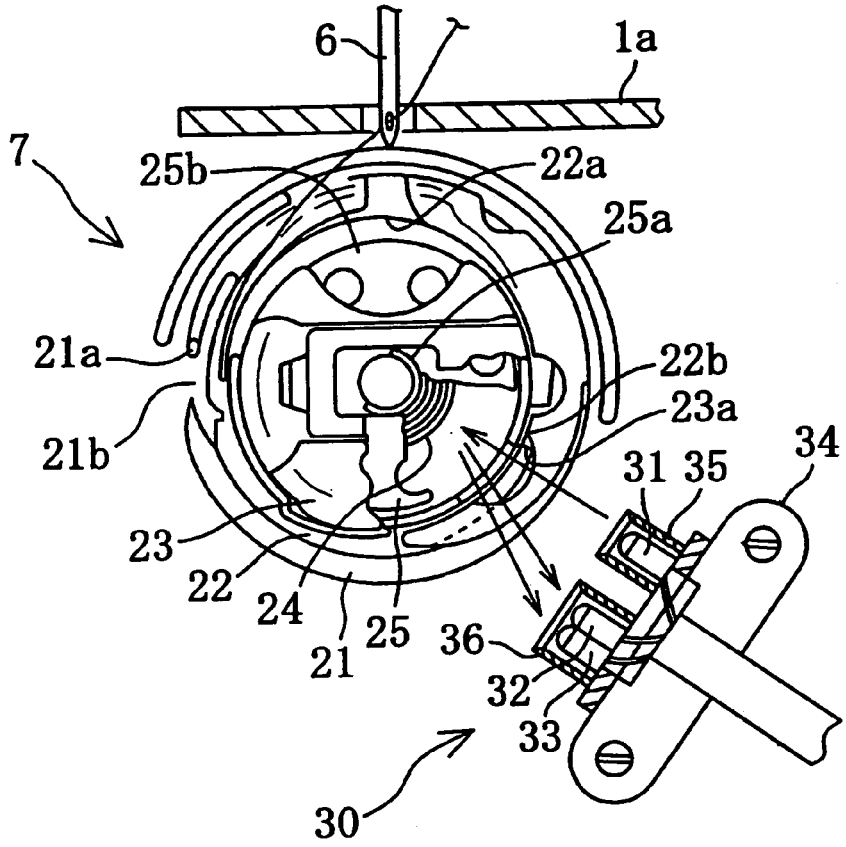
FIG. 2 is a front view of a rotary hook and a bobbin thread remaining amount detector.

Next, the bobbin thread remaining amount detector 30 is described with reference to FIG. 2. First, the rotary hook 7 having a bobbin 25 is briefly described.

As described earlier the rotary hook 7 is arranged below the needle plate 1*a* and is provided with an outer rotary hook 21 rotatable in synchronization with the vertical movement of the sewing needle 6 and a inner rotary hook 22 retained in the outer rotary hook 21. A tip 21*a* and notch 21*b* are formed on the outer rotary hook 21. The inner rotary hook 22 has an accommodation 22*a* and in the accommodation 22*a* a bobbin case 23 is installed in a located state. The bobbin case 23 is attached and detached in the forward direction from the accommodation 22*a*.

Inside the bobbin case 23, the bobbin 25 is detachably and rotatably attached. The bobbin 25 is composed of hollow shaft 25*a* wound with the bobbin thread 24 and a pair of hooks 25*b* provided on both ends of the hollow shaft 25*a*.

The bobbin thread remaining amount detector 30 is provided with one light emitting element 31 and two light receiving elements 32 and 33 in the vicinity of the rotary hook 7. The light emitting element 31 and light receiving elements 32 and 33 are mounted on a support body 34 fixed on the sewing machine frame not shown. On the end of the light emitting element 31 and light receiving elements 32 and 33, light collective lens are integrally formed. Also, the light emitting element 31 and light receiving elements 32 and 33 are covered by cases 35 and 36 having light permeable portions on their ends.

On the surrounding walls of the inner rotary hook 22 and bobbin case 23, openings 22*b* and 23*a* are provided which faces the notch 21*b* of the outer rotary hook 21 when the sewing needle 6 is in the needle raised position. Hence, in the above configuration, a path to connect the exterior and the interior of the rotary hook 7 passing through the notch 21*b* and opening 22*b* and 23*a* is formed, when in the needle raised position.

The control device 40 illuminates the light emitting elements 31 when the sewing needle 6 is in the needle raised position. At this point, the bobbin thread remaining amount is calculated from the ratio of the 2 detection signals provided by the two light receiving elements 32 and 33.

That is, the spot light generated by the light emitting element 31 when in the needle raised position passes through the notch 21*b* and the openings 22*b* and 23*a* to irradiate and reflect off the bobbin thread 24 wound on the bobbin 25. The reflected light passes through the notch 21*b* and the openings 22*b* and 23*a* towards the light receiving elements 32 and 33 and is received by the light receiving elements 32 and 33. The light receiving elements 32 and 33, which have received the reflected light, provide detection signals corresponding to the received light amount to the input interface 41 of the control device 40.

Figure 3:
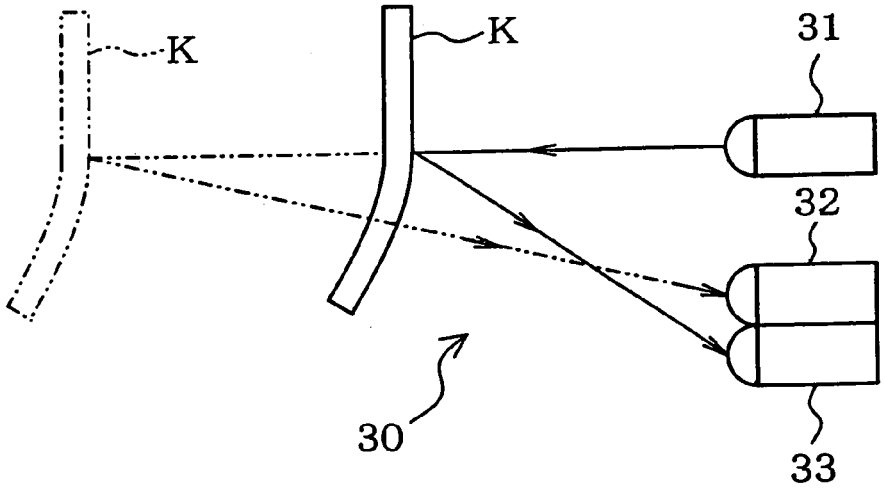
FIG. 3 is a descriptive figure of an optical system to calculate a bobbin thread remaining amount by a bobbin thread remaining amount detector.

FIG. 3 describes the difference of the amount of light received depending on the distance between the light emitting element 31 and the detecting target K, wherein the detecting target K is the bobbin thread 24. As shown in FIG. 3, the reflection angle (shown in actual line in FIG. 3) when the detecting target K and light emitting element 31 is in close distance is smaller than the reflection angle (shown in double-dotted chain line shown in FIG. 3) when in remote distance. Thus, when the reflection angle of the detection target changes, the amount of receiving light of the light receiving elements 32 and 33 change, in turn changing the ratio of the detection signals outputted from the light receiving elements 32 and 33. In the control device 40, the relation between a ratio of the detection signals outputted from the light receiving elements 32 and 33 and a remaining bobbin thread amount are stored as a bobbin thread remaining amount table. Therefore, the control device 40 can detect the bobbin thread remaining amount relatively reliably from the ratio of the detection signals outputted from the light receiving elements 32 and 33 and the bobbin thread remaining amount table. The bobbin thread remaining amount table will not be described in detail in this description.

Next, a control system of the embroidery sewing machine M is described with reference to FIG. 4. A control device 40 is provided with an input interface 41, a CPU 42, a ROM 43, a RAM 44, a computer including an electronically rewritable nonvolatile flash memory 45, an output interface 46, a bus 47 such as a data bus interconnecting the foregoing and a drive circuit 48 to 51 etc.

The input interface 41 is connected with a start/stop switch 12, an operation panel 11 having touch keys, light emitting element 31 and light receiving element 32 and 33 of the bobbin thread remaining amount detector 30 and a stop setting switch 13 etc. The output interface 46 is connected with drive circuits 48 to 50 for motors 52 to 54, a display controller (LDC) 55 for the color display (LCD) 10 and a drive circuit 51 for the X feed motor 18 and Y feed motor 19 of the embroidery frame drive mechanism 15.

In the ROM 43, a sewing control program is pre-stored to drive control the various drive mechanism as well as controlling the selection of actual patterns and embroidery patterns and various displays. The ROM 43 is further pre-stored with: a control program to control the management of bobbin thread remaining amount, which is included in the sew control program; and a bobbin thread remaining amount calculation control program and the like, to illuminate the light emitting element 31, when in the needle raised position and to calculate the bobbin thread remaining amount based on the ratio of the detection signals outputted from the light receiving element 32 and 33. The RAM 44 is provided with various types of memories, pointers and counters and the like to store the calculation results of the calculation processed by the CPU 42.

Figure 5:
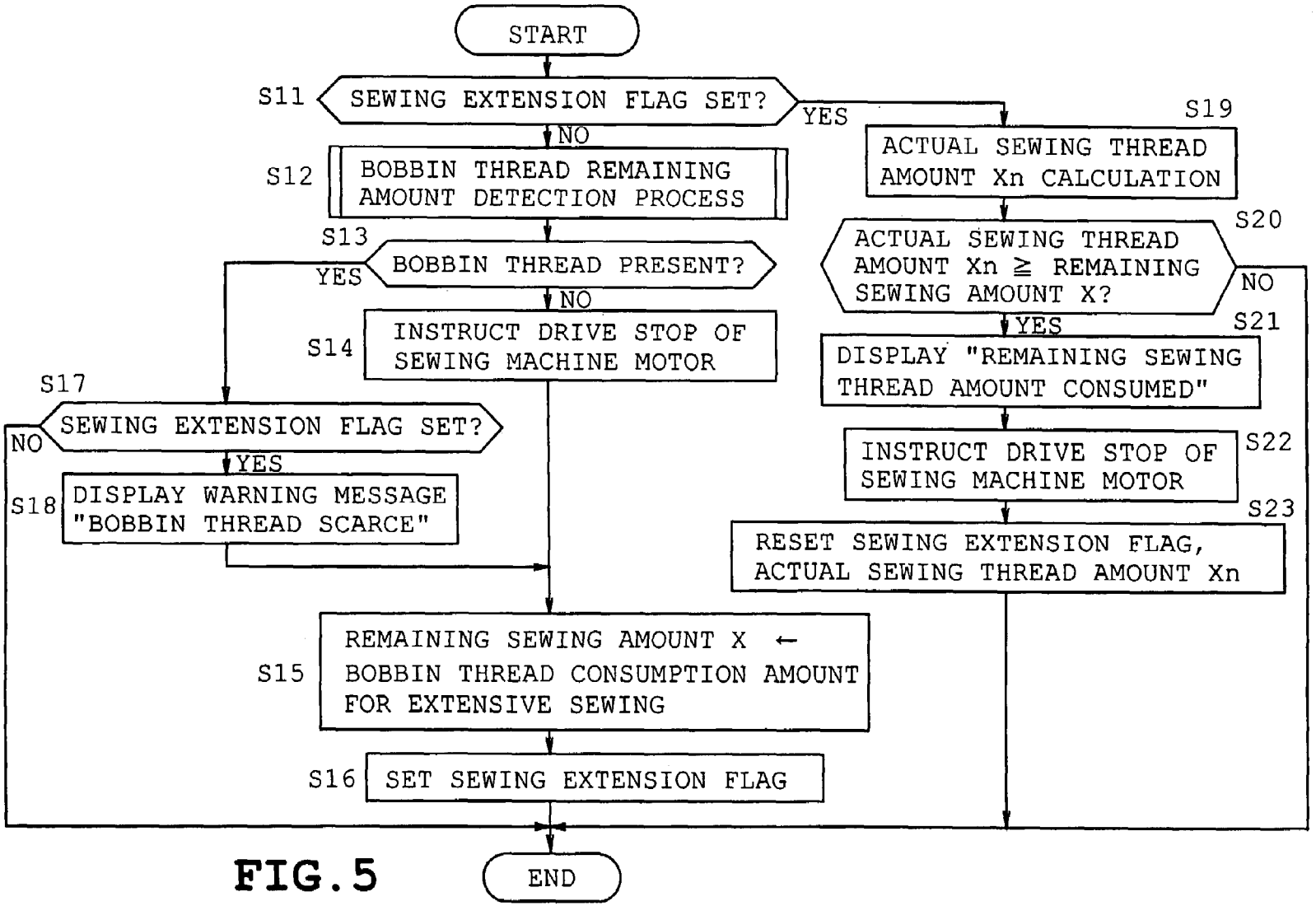
FIG. 5 is a flowchart of a management control of the bobbin thread remaining amount.

Next, a routine for a bobbin thread remaining amount management control is described based on the flow chart in FIG. 5. The bobbin thread remaining amount management control is executed as an interruption process to the main control whenever the sewing needle 6 reaches the needle raised position during the execution of the sewing process. In FIG. 5, codes Si (i=11, 12, 13 . . .) indicate each step.

This control is started when power is supplied by the power switch. At this point, a sewing extension flag to instruct the extension of sewing when the bobbin thread remaining amount becomes scarce has not been set (S11: No), and the bobbin thread remaining amount detection process is executed (S12).

Figure 6:
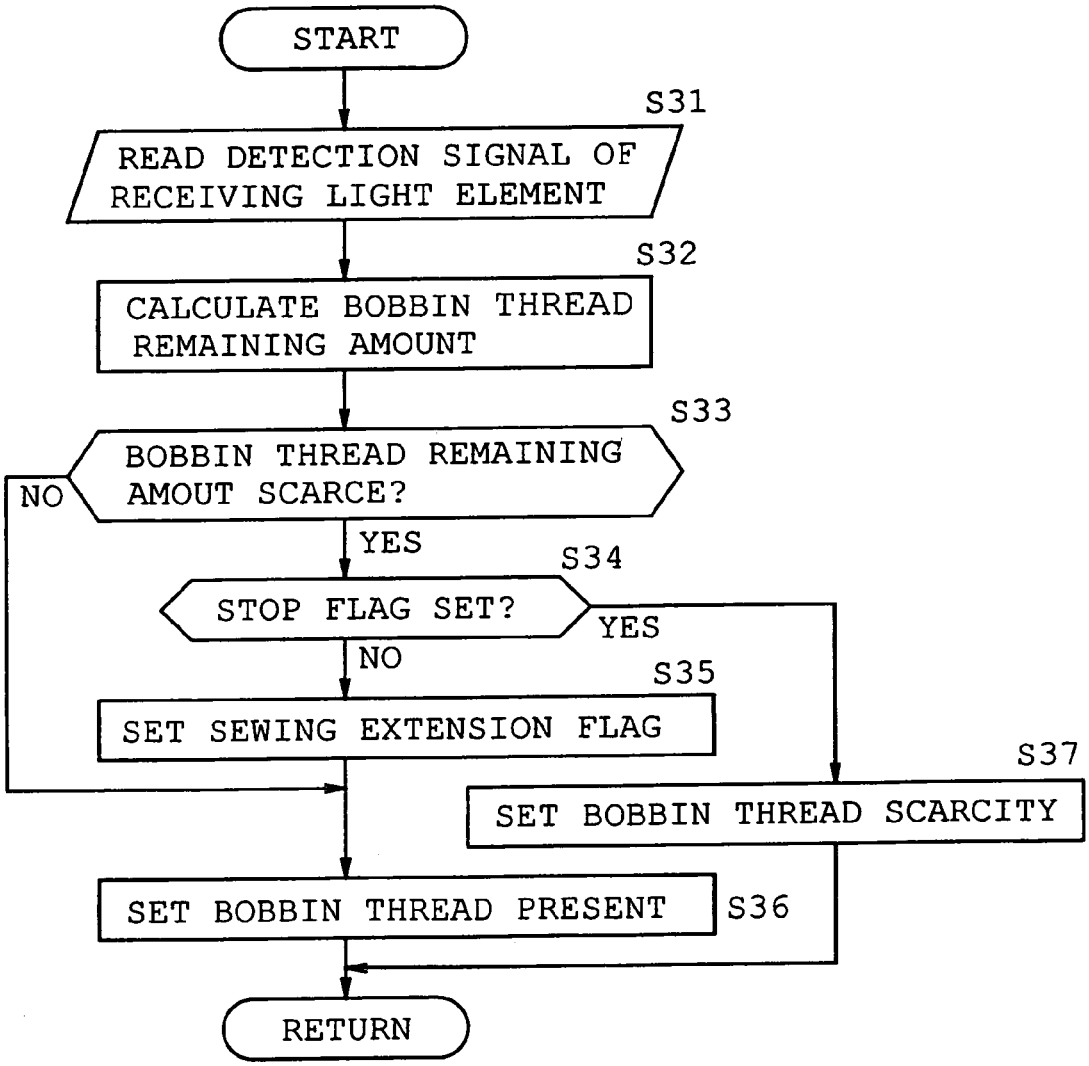
FIG. 6 is a flowchart of a detection process control of the bobbin thread remaining amount.
Figure 7:
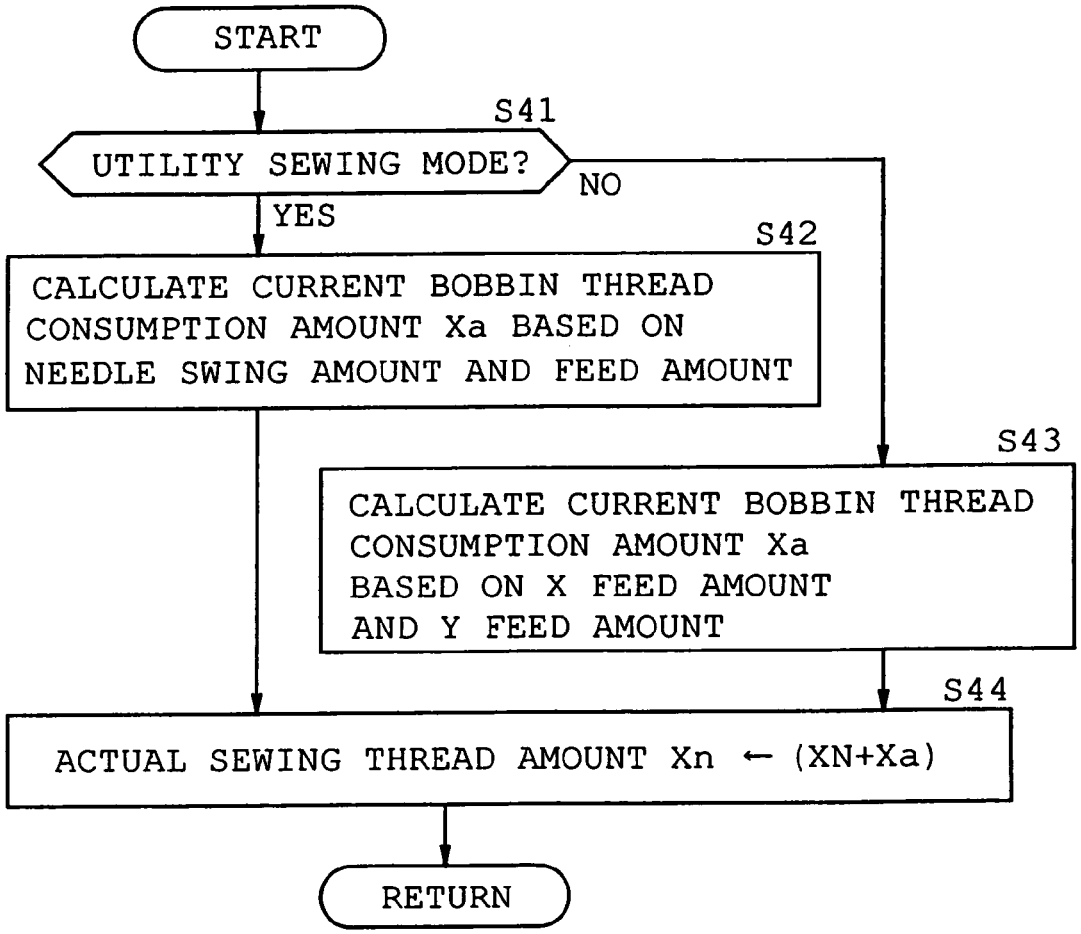
FIG. 7 is a flowchart of a calculation process control of the actual sewing amount.

The bobbin thread remaining amount detection process is executed in accordance with the flowchart shown in FIG. 6. That is, after the detection signals provided from the two light receiving elements 32 and 33 are read (S31), the bobbin thread remaining amount is calculated (S32) based on the bobbin thread remaining amount table.

As a result of the calculation of bobbin thread remaining amount, if the scarcity of the bobbin thread remaining amount is denied (S33: No), a bobbin thread remaining state is set (S36) to complete this process and the control is returned to S13. On the other hand, if the scarcity of the bobbin thread remaining amount is confirmed (S33: Yes), and in case the stop mode is not set by the stop setting switch 13 and the stop flag is not set (S34: No), the sewing extension flag is set (S35) and the control is returned to S13 after setting the bobbin thread remaining state (S36). As opposed to this, in case the stop flag is set (S34: Yes), after setting a bobbin thread scarcity state (S37), the control is returned to S13.

In S13, the scarcity of the bobbin thread remaining amount is determined. If it is determined to be in bobbin thread present state (S13: Yes), and in case the sewing extension flag is not set, (S17: No), that is, if there is enough bobbin thread remaining amount, this control is terminated. On the other hand, in case the sewing extension flag is set (S17: Yes), a warning message, "bobbin thread scarce" is displayed (S18) to the display 10. A bobbin thread consumption amount for extensive sewing (for example, 50 cm) is preset (S15) as a remaining sewing amount X via the remaining sewing amount setting screen displayed to the operation panel 11. Then, after setting the sewing extension flag (S16), this process is terminated. The aforementioned remaining sewing amount corresponds to the permitted sewing amount of the disclosure.

As opposed to this, if the scarcity of the bobbin thread is confirmed in S13 (S13: No), an instruction to stop the drive of the sewing machine motor 52 is outputted (S14) and then through S15 and S16 the process is terminated. Subsequently, by the user's operation of the start/stop switch 12, the sewing machine motor 52 is re-driven to re-start the sewing process.

Also, in case the sewing extension flag is set (S11: Yes) when this control is started, the calculation process to calculate the actual sewing thread amount Xn is executed (S19). The calculation process to calculate the actual sewing amount Xn is performed according to the flow chart in FIG. 7. First, the sewing mode is determined (S41). Then, in case the embroidery frame drive mechanism 15 is not attached to the bed 1 and the utility sewing mode is set (S41: Yes), the needle swing amount and feed amount are arrived from the drive pulse count of the needle bar swinging stepping motor 53 and feed dog drive stepping motor 54 in the sewing operation performed immediately before reaching the needle raised position. Based on such needle swing amount and the feed amount, the current actual consumed thread amount Xa is calculated (S42).

On the other hand, in case the embroidery frame drive mechanism 15 is attached to the bed 1 and the embroidery sewing mode is set (S41: No), the x feed amount and the y feed amount are arrived from the drive pulse count of an X feed motor 18 and a Y feed motor 19 in the sewing operation performed immediately before reaching the needle raised position. Based on such x feed amount and y feed amount, the current actual consumed thread amount Xa is calculated (S43).

In S44, the current consumed thread amount Xa is added to the accumulated actual sewing thread amount Xn to calculate the current actual sewing thread amount Xn. Then, the process is completed and the control returns to S20 of the bobbin thread remaining amount management control.

In S20, in case the current actual sewing thread amount Xn is determined to be less than the remaining sewing amount X (S20: No), this control is terminated. On the other hand, in case the current actual sewing thread amount Xn is determined to be equal or more than the remaining sewing amount X (S20: No), a message "remaining sewing amount consumed" is displayed to the color display 10 (S21). Then, after the drive stop of the sewing machine motor 52 is instructed (S22), the sewing extension flag and the actual sewing thread amount Xn is reset (S23) and the control is terminated.

Thus, in the present embodiment, in case the scarcity of the remaining amount of the bobbin thread 24 is detected by the bobbin thread remaining amount detector 30, the remaining sewing amount, with which the sew is performed using the bobbin thread remaining in the bobbin 25, is preset to the bobbin thread consumption amount. Additionally, as well as enabling the stop of the sewing machine motor 52 when the remaining bobbin thread has become scarce, or enabling the continuation of sew after the warning message has been displayed; in the event that the actual sewing amount has reached the pre-set sewing amount, such status is displayed to the color display 10. Therefore, the bobbin thread 24 remaining in the bobbin 25 can be efficiently used for sewing.

Figure 8:
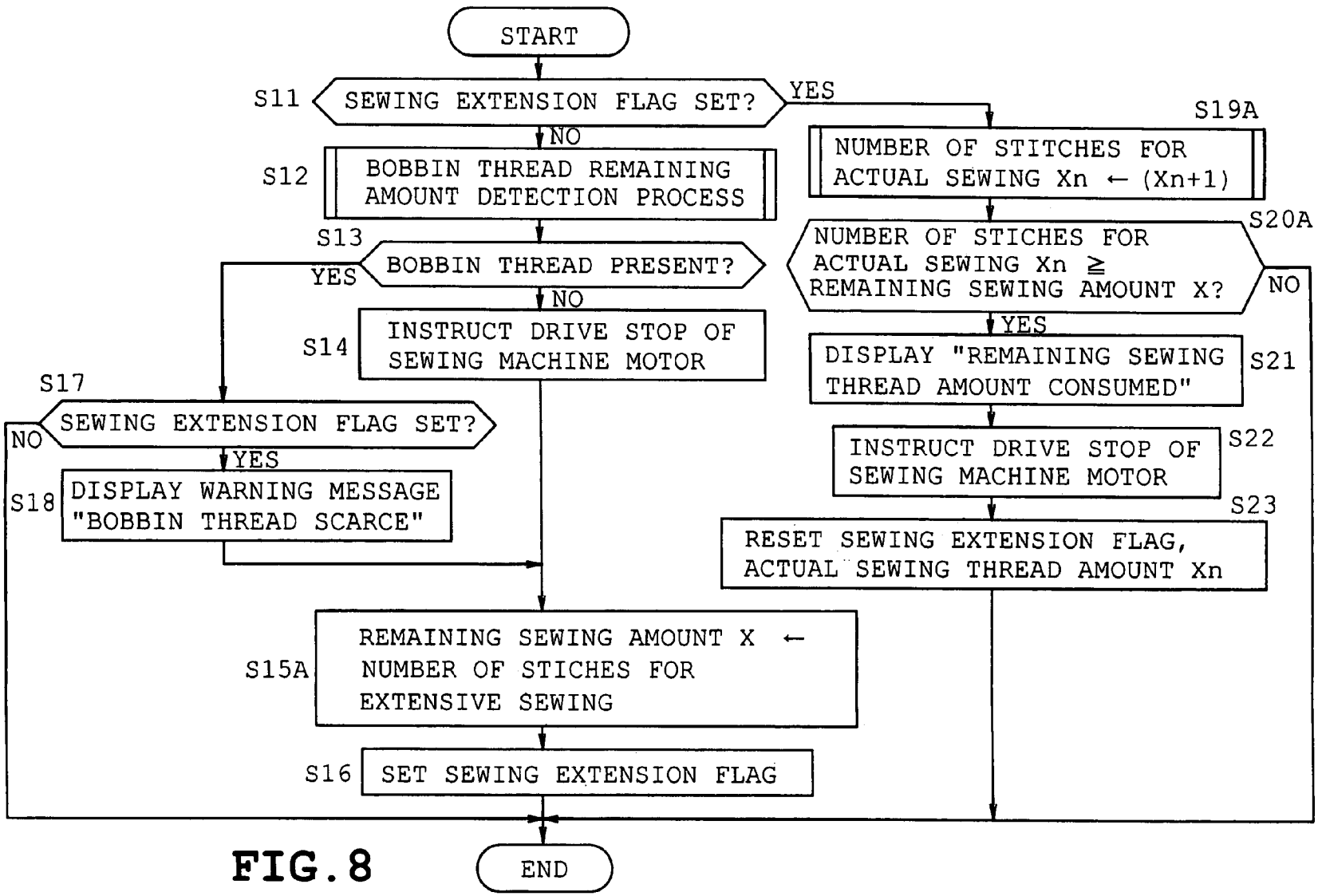
FIG. 8 corresponds to FIG. 6 relates to the second embodiment of the disclosure.

FIG. 8 shows the second embodiment of the disclosure and the portions that differ from the first embodiment are herein after described. In the second embodiment, the remaining sewing amount in the bobbin thread remaining amount management control is set by the number of stitches. That is, in S15A of FIG. 8, a predetermined number of stitches for extensive sewing (for example 60 stitches). Also, in case the sewing extension flag is set (S11: Yes), actual number of sewing stitches Xn is incremented by 1 (S19A). In case the actual number of sewing stitches Xn equals or exceeds the remaining sewing amount X (S20A: Yes), a message "remaining sewing amount consumed" is displayed to the color display 10 (S21). The configuration besides the above is the same as the first embodiment.

Thus, even in the case, in which the bobbin thread amount remaining in the bobbin 25 is preset as the remaining sewing amount, the effect of the first embodiment can be obtained.

This disclosure is not limited to the above described embodiments but can be transformed as follows.

The bobbin thread remaining amount detector 30 can be configured by a permeable type light sensor instead of a reflecting type light sensor. Also, instead of an optical bobbin thread remaining amount detector, a bobbin thread remaining amount detector having a detection stick contacting the detection target can be used to detect the bobbin thread remaining amount.

In the embroidery sewing mode, the bobbin thread consumption amount Xa can be arrived from the x feed amount and y feed amount arrived from the relative coordinates of the embroidery data used in the current embroidery sewing process. Also, in the utility sewing mode, the current bobbin thread consumption amount Xa can be arrived by the selected type of actual patterns.

The foregoing description and drawings are merely illustrative of the principles of the disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A control device of a sewing machine driven by a sewing machine motor to execute a sewing operation using a needle thread and a bobbin thread, the control device comprising:

a bobbin thread remaining amount detection unit that detects a bobbin thread remaining amount;

a stopping unit that stops the sewing machine motor when a scarcity of a remaining amount of the bobbin thread is detected by the bobbin thread remaining amount detecting unit;

a sewing restarting unit that restarts the sewing operation after stopping the sewing machine motor by the stopping unit;

a permitted sewing amount setting unit that sets a permitted sewing amount after stopping the sewing machine motor by the stopping unit;

an actual sewing amount calculation unit that calculates an actual sewing amount after stopping the sewing machine motor by the stopping unit; and an informing unit that informs when the actual sewing amount calculated by the actual sewing amount calculation unit reaches the permitted sewing amount.

2. A control device of a sewing machine driven by a sewing machine motor to execute a sewing operation using a needle thread and a bobbin thread, the control device comprising:

a bobbin thread remaining amount detection unit that detects a bobbin thread remaining amount;

a warning unit that outputs a warning when a scarcity of the remaining amount of the bobbin thread is detected by the bobbin thread remaining amount detecting unit;

a permitted sewing amount setting unit that sets a permitted sewing amount after outputting the warning by the warning unit;

an actual sewing amount calculation unit that calculates an actual sewing amount after outputting the warning by the warning unit; and an informing unit that informs when the actual sewing amount calculated by the actual sewing amount calculation unit reaches the permitted sewing amount.

3. The control device according to claim 1, wherein the permitted sewing amount setting unit is arranged to set the permitted sewing amount by the number of stitches and the actual sewing amount calculation unit is arranged to calculate the actual sewing amount by the number of stitches.

4. The control device according to claim 2, wherein the permitted sewing amount setting unit is arranged to set the permitted sewing amount by the number of stitches and the actual sewing amount calculation unit is arranged to calculate the actual sewing amount by the number of stitches.

5. The control device according to claim 1, wherein the permitted sewing amount setting unit is arranged to set the permitted sewing amount by a consumption amount of the bobbin thread and the actual sewing amount calculation unit is arranged to calculate the actual sewing amount by the consumption amount of the bobbin thread.

6. The control device according to claim 2, wherein the permitted sewing amount setting unit is arranged to set the permitted sewing amount by the consumption amount of the bobbin thread and the actual sewing amount calculation unit is arranged to calculate the actual sewing amount by the consumption amount of the bobbin thread.

7. The control device according to claim 1, wherein the stopping unit is arranged to stop the sewing machine motor when the informing unit has informed that the actual sewing amount has reached the permitted sewing amount.

8. The control device according to claim 2, wherein the stopping unit is arranged to stop the sewing machine motor when the informing unit has informed that the actual sewing amount has reached the permitted sewing amount.

9. The control device according to claim 1, wherein the sewing machine having a feed dog, a feed dog drive motor to drive the feed dog, a needle bar, a needle bar swinging motor to swing the needle bar and a detachable embroidery apparatus provided with an x-y feeding device to move the embroidery frame to an x direction and a y direction is arranged to selectively execute between an embroidery mode, wherein the embroidery operation is performed by moving the embroidery frame by the x-y feeding device and a utility sewing mode, wherein the sewing operation is performed by driving the feed dog while swinging the needle bar; and when in the embroidery mode, the actual sewing amount calculation unit calculates the actual sewing amount based on a travel distance of the x direction and y direction, whereas, when in the utility sewing mode, the actual sewing amount calculation unit calculates the actual sewing amount based on a drive amount of the feed dog and a swing amount of the needle bar.

10. A control program stored in a computer-readable medium of a sewing machine to execute a sewing operation using a needle thread and a bobbin thread wound on a bobbin driven by a sewing machine motor, the control program comprising:

a bobbin thread remaining amount detection routine that detects a bobbin thread remaining amount;

a stopping routine that stops the sewing machine motor when a scarcity of the remaining amount of the bobbin thread is detected;

a permitted sewing amount setting routine that sets a permitted sewing amount after stopping the sewing machine motor;

an actual sewing amount calculation routine that calculates an actual sewing amount after the stopping the sewing machine motor; and an informing routine that informs when an actual sewing amount calculated by the actual sewing amount calculation unit reaches the permitted sewing amount.

11. The control program according to claim 10, wherein the permitted sewing amount setting routine is arranged to set the permitted sewing amount by the number of stitches and the actual sewing amount calculation routine is arranged to calculate the actual sewing amount by the number of stitches.

12. The control program according to claim 10, wherein the permitted sewing amount setting routine is arranged to set the permitted sewing amount by a consumption amount of the bobbin thread and the actual sewing amount calculation routine is arranged to calculate the actual sewing amount by the consumption amount of the bobbin thread.

13. The control program according to claim 10, wherein the stopping routine stops the sewing machine motor when the scarcity of the remaining amount of the bobbin thread is informed.

* * * * *